US006267649B1

(12) United States Patent
Lai et al.

(10) Patent No.: US 6,267,649 B1
(45) Date of Patent: Jul. 31, 2001

(54) EDGE AND BEVEL CMP OF COPPER WAFER

(75) Inventors: Han-Chung Lai, Tauryuan; Hung-Wen Chiou, Hsinchu, both of (TW)

(73) Assignee: Industrial Technology Research Institute, Hsin-Chu (TW)

( * ) Notice: Subject to any disclaimer, the term of this patent is extended or adjusted under 35 U.S.C. 154(b) by 0 days.

(21) Appl. No.: 09/378,947

(22) Filed: Aug. 23, 1999

(51) Int. Cl.[7] ..... B24B 9/06
(52) U.S. Cl. ..... 451/44; 451/41; 451/397
(58) Field of Search ..... 451/41, 43, 44, 451/397, 398

(56) References Cited

U.S. PATENT DOCUMENTS

| | | | | |
|---|---|---|---|---|
| 4,344,260 | * | 8/1982 | Ogiwara | 451/44 |
| 4,718,202 | * | 1/1988 | Worsham | 51/283 E |
| 5,295,331 | * | 3/1994 | Honda et al. | 451/44 |
| 5,317,836 | * | 6/1994 | Hasegawa et al. | 51/106 R |
| 5,547,415 | | 8/1996 | Hasegawa et al. | 451/44 |
| 5,658,189 | * | 8/1997 | Kagamida | 451/66 |
| 5,725,414 | * | 3/1998 | Moinpour et al. | 451/41 |
| 5,727,990 | | 3/1998 | Hasegawa et al. | 451/44 |
| 5,855,735 | | 1/1999 | Takada et al. | 156/636.1 |
| 5,866,477 | | 2/1999 | Ogawa et al. | 438/626 |
| 5,882,539 | | 3/1999 | Hasegawa et al. | 216/88 |
| 5,944,584 | * | 8/1999 | Yoyama | 451/43 X |
| 6,093,087 | * | 7/2000 | Hakomori et al. | 451/44 X |

* cited by examiner

*Primary Examiner*—Joseph J. Hail, III
*Assistant Examiner*—Anthony Ojini
(74) *Attorney, Agent, or Firm*—George O. Saile; Stephen B. Ackerman

(57) ABSTRACT

A new method is provided to edge and bevel the periphery of a semiconductor substrate. The wafer is positioned in a horizontal plane and held in place against two positioning pegs. The wafer is rotated and slurry is distributed over the periphery of the substrate surface. The periphery of the wafer is entered into one or more abrasive fixtures, also referred to as bevel/edge heads. These abrasive fixtures will create the desired edge and the desired bevel around the periphery of the substrate.

13 Claims, 6 Drawing Sheets

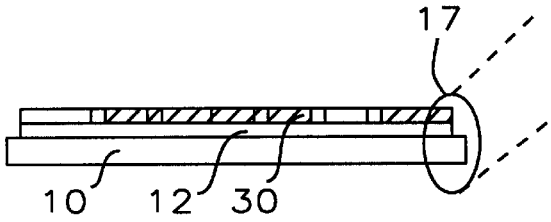
FIG. 4a
Prior Art
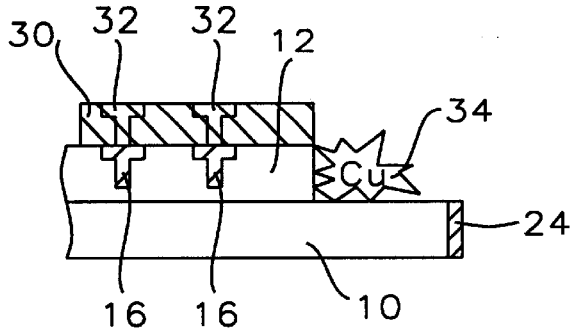
FIG. 4b
Prior Art
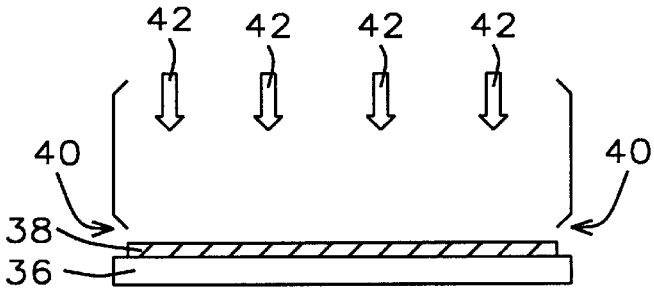
FIG. 5 – Prior Art
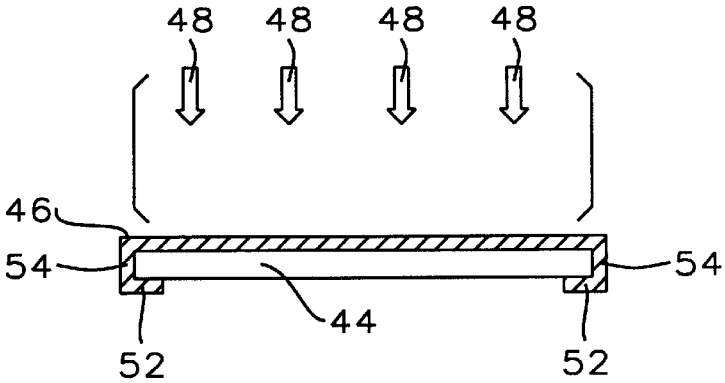
FIG. 6 – Prior Art

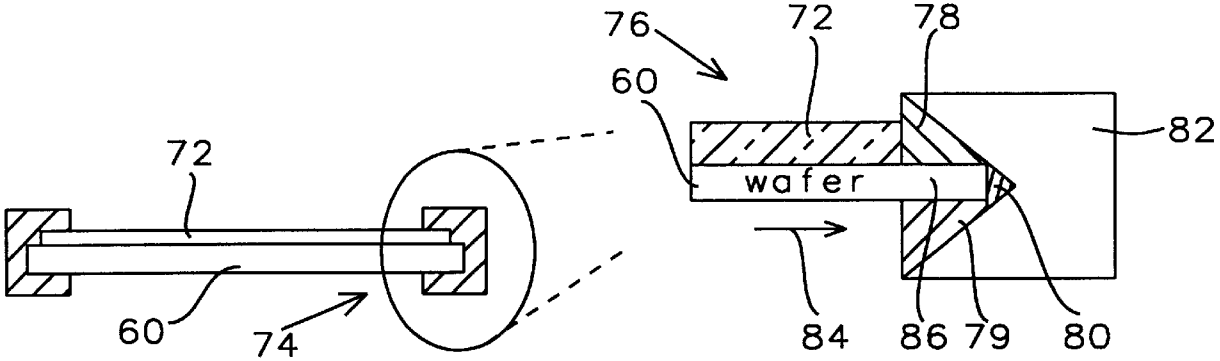
FIG. 10b
FIG. 10a
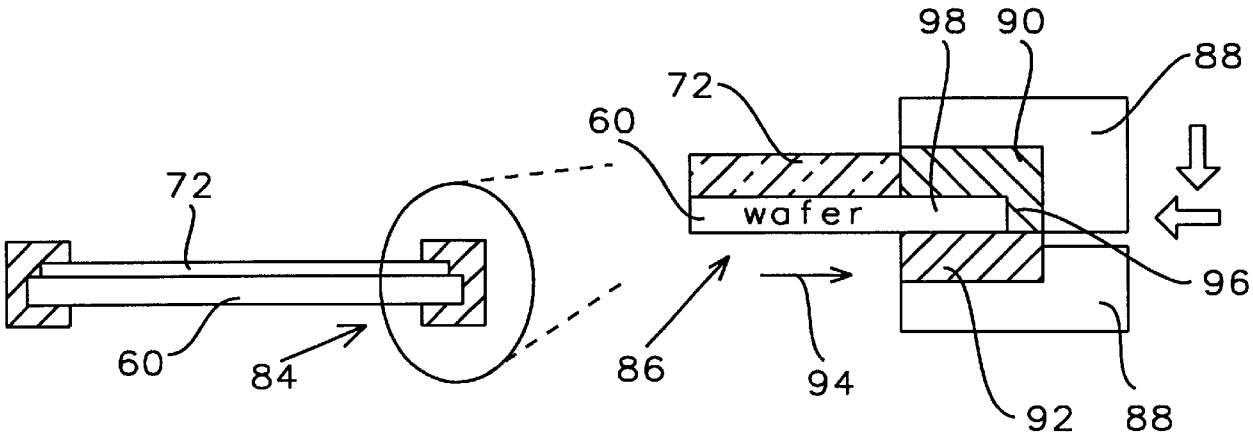
FIG. 11b
FIG. 11a

EDGE AND BEVEL CMP OF COPPER WAFER

BACKGROUNG OF THE INVENTION (1) Field of the Invention

The invention relates to the fabrication of integrated circuit devices, and more particularly, to a method of polishing the edge of a wafer on which copper has been deposited by using a contour-shaped pad.

(2) Description of the Prior Art

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may include abrasive materials therein, is maintained on the polishing pad to modify the polishing characteristics of the polishing pad in order to enhance the polishing of the substrate.

The profile of the polishing pad plays an important role in determining good overall polishing results. The polishing pad can, for instance, be profiled thick at the inner diameter of the polishing pad as compared to the outer diameter of the polishing pad and visa versa. The profile of the polishing pad is typically achieved by trial and error and by adjusting the position of a diamond dresser. This method of profiling the polishing pad is destructive, time consuming and causes the loss of the polishing pad. Since this measure of the polishing pad profile can only be performed at the end of the useful life of the polishing pad, the wrong profile can only be detected after the polishing pad has served its useful life.

A polishing pad is typically fabricated from a polyurethane and/or polyester base material. Pads can for instance be specified as being made of a microporous blown polyurethane material having a planar surface and a Shore D hardness of greater than 35 (a hard pad). Other materials used for polishing pads are foam polyurethane, sueded foam polyurathene, unwoven fabric, resin-impregnated unwoven fabric. Semiconductor polishing pads are commercially available such as models IC1000 or Scuba IV of a woven polyurethane material.

One factor, which contributes to the unpredictability and non-uniformity of the polishing rate of the CMP process, is the non-homogeneous replenishment of slurry at the surface of the substrate and the polishing pad. The slurry is primarily used to enhance the rate at which selected materials are removed from the substrate surface. As a fixed volume of slurry in contact with the substrate reacts with the selected materials on the surface of the substrate, this fixed volume of slurry becomes less reactive and the polishing enhancing characteristics of that fixed volume of slurry is significantly reduced. One approach to overcoming this problem is to continuously provide fresh slurry onto the polishing pad. Slurry typically includes pH-balanced chemicals, such as sodium hydroxide, and silicon dioxide particles.

This approach presents at least two problems. Because of the physical configuration of the polishing apparatus, introducing fresh slurry into the area of contact between the substrate and the polishing pad is difficult. Providing a fresh supply of slurry to all positions of the substrate is even more difficult. As a result, the uniformity and the overall rate of polishing are significantly affected as the slurry reacts with the substrate.

In the art of fabricating semiconductors, it is important that the surface of a semiconductor wafer be planar in order to meet the requirements of optical projection lithography. The assurance of planarity is crucial to the lithography process, as consistent and uniform depth of focus of the lithography process across a surface is often inadequate for surfaces that do not have good planarity.

During the fabrication of VLSI and ULSI semiconductor wafers, it is also critically important to use wafers that are free of any surface $Cu^{+}$ or $Cu^{++}$ ions since the presence of these impurities has a direct and negative effect on device yield and throughput. It is therefore of extreme importance to use effective means for the control and removal of these impurities from the surface of the wafer since these impurities may, during further high temperature processing steps, diffuse into the wafer surface thereby substantially altering the chemical composition of the wafer. In addition, impurities can be classified as donor or acceptor dopants; these dopants will have an impact on the performance of subsequently produced semiconductor devices. Yet other impurities may cause surface dislocations or internal stacking misalignments or faults further having a negative impact on semiconductor manufacturing yield and cost. It is therefore clear that an effective method must be available to thoroughly clean the surface of the semiconductor substrate from all impurities while this process of removal may have to be repeated at various intervals during the complete processing sequence.

In the conventional approach, the wafer is held in a circular carrier, which rotates. The polishing pads, made from a synthetic fabric, are mounted on a polishing platen which has a flat surface and which rotates. The rotating wafer is brought into physical contact with the rotating polishing pad; this action constitutes the Chemical Mechanical Polishing process. Slurry, which typically includes pH-balanced chemicals, such as sodium hydroxide, and silicon dioxide particles, is dispensed onto the polishing pad typically using a peristaltic pump. The excess slurry typically goes to a drain, which means that the conventional CMP process has an open loop slurry flow and therefore may use and dispense with an excessive amount of slurry that may add significantly to the processing cost. During this process of polishing, rate of slurry flow must also be exactly controlled.

One of the techniques of removing surface layers from the surface of a substrate is the method of lapping. For this method, a work surface is pressed against a rotating plate, typically made of a metal, while slurry of abrasive material is passed between the work surface and the plate. Double lapping can be accomplished by pressing the substrate between two rotating plates that rotate in opposite directions. While the process applied during lapping strongly resembles the process of the conventional CMP, the severity of the abrasive action between the work surface and the rotating plates can result in deep micro-fissures in the piece of the work surface. These micro-fissures or cracks need to be further removed (by chemical etching and polishing) before the surface of the wafer becomes of acceptable quality.

The process of polishing a wafer surface also requires that the work surface be pressed against a rotating pad while abrasive slurry is fed between the work surface and the pad.

Polishing is frequently used in applications where, in applying the CMP process to Intra-Level Dielectric (ILD) and Inter Metal Dielectric (IMD) that are used for the manufacturing of semiconductor wafers, surface imperfections (micro-scratch) present a problem. Imperfections caused by micro-scratches in the ILD and IMD can range from 100 to 1000 EA for 200 mm. wafers, where an imperfection typically has a depth from 500 to 900 Å and a width of from 1000 to 3000 $Å^0$. As part of the polishing process of the ILD and IMD, a tungsten film is deposited; the surface imperfections will be filled with tungsten during this deposition. For devices within the semiconductor wafer with a dimension of 0.35 um or larger, an etching process is used where the tungsten that has entered the imperfections within the wafer surface can be removed. For the larger size devices within the semiconductor wafer there is therefore no negative impact on the yield of these devices. For device sizes within the semiconductor wafer of 0.25 um or less, the indicated procedure of etching the tungsten layer is no longer effective. This results in relative large imperfections within the surface of the wafer, large with respect to the size of the semiconductor devices. These imperfections will cause shorts between the metal lines within the devices while the imperfections also have a severe negative impact on device yield and device reliability.

Mechanical Chemical Polishing uses the addition of various chemicals and abrasive slurry. The added chemicals are matched to the material that is being polished.

Traditional processes of chamfering have to content with problems caused by the non-uniformity of the edge of the wafer that is being chamfered. The thickness of the surface of the wafer that is being chamfered can vary around the periphery of the wafer. In addition, the profile of the chamfered periphery of the wafer that has been created via processing steps of chamfering, lapping and etching can also vary along the periphery of the wafer. Wafer planarity may further play a negative role in the quality of the process. Wherever non-uniformity of any of these dimensional parameters of the wafer periphery occurs, the wafer that is being processed is subjected to non-uniform contact with the processing tool. The abrasive action caused by this processing tool on the wafer surface is therefore also non-uniform, resulting in an uneven removal of the layers from the surface of the wafer. It is clear that, under ideal conditions, profile and planarity of the work piece must approach the ideal in uniformity and consistency. It is also clear that any tool or method that is used for substrate edge and bevel shaping and that, by its design or by the manner in which the tool applies the process, reduces the impact of substrate edge profile and planarity irregularities, will be of benefit in creating the desired results.

During traditional PVD of CVD processes of copper, the deposition of copper at the edge of the wafer bevels. This beveling of the deposited copper results in unequal removal rate of the copper from the surface that is being polished, leading to excess contamination of the processing chamber with copper residue. This copper residue will have a serious negative yield impact on the devices that are created as previously highlighted. The invention provides a new method of removing contaminating copper deposits by means of a CMP process.

FIGS. 1*a* through 3*a* show examples of cross sections of substrates during a number of processing steps and the results that these processing steps have on the periphery of the substrate.

FIG. 1*a* shows a cross section of a substrate 10 (and its periphery) on which a layer 12 of dielectric (for instance $Si_2O$) has been deposited. FIG. 1*b* is as further detailed cross section of area 11 of FIG. 1*a*.

FIG. 1*b* shows how device features 16, in this example dual damascene structures, have been created in the dielectric layer 12, a blanket layer 14 of copper has been deposited over the surface of the dielectric 12 and inside the dual damascene structures 16. The deposited layer 14 of copper will diffuse over the edge of the dielectric 12 and the substrate 10 and form deposits whose cross sections have been highlighted with 18 and 20. FIG. 2*b* is as further detailed cross section of area 13 of FIG. 2*a*.

FIG. 2*a* shows a cross section of the substrate 10 (and its periphery) with the above indicated device features after the copper layer 14, FIG. 1*b*, has been removed by Chemical Mechanical Polishing. It must be emphasized at this point that the method that is used to remove layer 14 is not critical or of importance to the invention.

FIG. 2*b* shows that the deposited copper has only been removed from the surface of the dielectric layer 12 and has essentially remained in place around the periphery of the substrate forming deposits 22 and 24. These deposits need to be further removed for the reasons indicated above, that is that these deposits will, during subsequent processing steps, be (completely or partially and in an uncontrolled manner) removed from the locations as shown in FIG. 2*b* and will, in so doing, form processing contaminants that have a serious negative device yield impact in addition to forming deposits on the sidewalls of the processing chamber. The profile 22 as shown in FIG. 2*b* is not the same as the profile 18 that is shown in FIG. 1*b*. This difference is not important to the invention. Profiles 18/20 (FIG. 1*b*) and 22/24 (FIG. 2*b*) are essentially the same but this too is not important to the invention.

FIG. 3*a* shows a cross section of the substrate 10 (and its periphery) after a second layer 26 of Inter Metal Dielectric (IMD) has been deposited over the surface of the first layer of dielectric 12. This layer 26 of dielectric has been deposited, as is standard practice in the art, to create additional device features in this layer. These other device features may or may not interact with device features 16 in layer 12. FIG. 3*b* is as further detailed cross section of area 15 of FIG. 3*a*.

Noteworthy in FIG. 3*b* is the area 28 of the dielectric 26 where the dielectric 26 is in direct contact with the underlying copper 22. Under certain conditions, these two superimposed layers of dielectric 28 and copper 22 may not chemically interact with each other. Where however the device that is shown in cross section in FIGS. 3*a* and 3*b* is further processed, these two layers will (due to the chemical nature of the two layers 22 and 28 stimulated by high processing temperatures, cross interface diffusion and others) interact or have the likelihood of interacting.

FIG. 4*a* shows a cross section where device features 32, in this case again dual damascene structures, have been created in layer 30. FIG. 4*b* is as further detailed cross section of area 17 of FIG. 4*a*. The process of creating these features 32 is a process that requires the deposition of photoresist, the patterning of this resist and the (one or multiple step) etching of features 32. During these processing steps of repeated exposure to elevated temperatures combined with the deposition and removal of chemicals that are used, the copper/IMD combination (22/28 of FIG. 3*b*) interacts and forms contaminants 34 of considerable chemical complexity. The key aspect of this contaminant is that it is "not meant to be there" and "uncontrolled"; meaning that the contaminant created in this manner must be prevented from occurring.

FIG. 5 shows a cross section of a substrate during a cycle of processing of the substrate. Substrate 36 has been placed on a substrate carrier or table (not shown); this inside a processing chamber (not shown) used for the deposition of a layer of copper. Gasses 40 enter the chamber as part of the copper deposition process; copper 42 is deposited, using for example the CVD process, forming a layer 38 of copper on the surface of substrate 36. Since the entrance points of gasses 38 is close to the periphery of the deposited layer 38 of copper, the deposited copper has a tendency to be deposited in an uneven manner across the surface of the substrate where the deposited layer 38 tends to be thicker in the center of the substrate 36.

FIG. 6 shows a cross section of a substrate 44 that indicates that, during deposition 48 of copper 46 on the surface of substrate 44, the copper "wraps around" the surface of the substrate and creates copper backside 52 and edge 54 depositions. These depositions are one more example of the deposition of a layer of copper that does not meet ideal requirements, that is an even layer of copper over those areas of the substrate where the copper needs to be deposited.

U.S. Pat. No. 5,866,477 (Ogawa et al.) teaches a method for polishing a chamfered portion of a semiconductor silicon substrate. The substrate is tilted at a designated chamfer angle; this chamfer angle is the angle being the angle between the plane of the surface being polishing and the polishing pad. The chamfer angle can be reversed thereby providing the means of mirror polishing the edge of the substrate. The Patent essentially focuses on providing edge relief of an oxidized silicon layer and/or an intrinsic gettering layer.

U.S. Pat. No. 5,882,539 (Hasegawa et al.) teaches a method of polishing a chamfered etch of a wafer. The method goes to a sequence of steps of chamfering the edge of the wafer (to prevent peripheral portions of the wafer from chipping off), lapping the wafer (to promote uniform thickness of the wafer) and etching the chamfered portion of the wafer (for removal of cracked and contaminated portions of the wafer). A number of polishing and grinding steps are further performed to complete the process of polishing the wafer.

U.S. Pat. No. 5,727,990 (Hasegawa et al.) discloses a method and apparatus for mirror-polishing a peripheral portion of a semiconductor wafer. A pad with a V-shape is used for this purpose.

U.S. Pat. No. 5,547,415 (Hasegawa et al.) shows methods and apparatus to polish the edge of a wafer.

U.S. Pat. No. 5,8855,735 (Takada et al.) teaches a polish and lapping method to remove films from a wafer.

SUMMARY OF THE INVENTION

A principle objective of the invention is to remove copper deposits from the periphery of a substrate surface.

Another objective of the invention is to eliminate current efforts that are aimed at preventing the build-up of copper along the periphery of a semiconductor substrate.

Yet another objective of the invention is to provide a method that creates desired bevels and edges around the periphery of a semiconductor substrate.

A still further objective of the invention is to provide polishing pads that can be used for the removal of copper deposited along the periphery of a semiconductor substrate.

Yet another objective of the invention is to provide polishing pads that can be used for bevel and edge control along the periphery of a semiconductor substrate that are not limited to Chemical Mechanical Polishing procedures.

In accordance with the objectives of the invention a new method is provided to bevel and edge the periphery of a semiconductor substrate. The wafer is positioned in a horizontal plane and held in place against two positioning pegs. The wafer is rotated and slurry is distributed over the periphery of the substrate surface. The periphery of the wafer is entered into one or more abrasive fixtures, also referred to as bevel/edge heads. These abrasive fixtures will create the desired bevel and the desired edge around the periphery of the substrate.

BRIEF DESCRIPTION OF THE DRAWINGS

FIGS. 4*a* and 4*b* shows a cross section of the substrate of FIGS. 3*a* and 3*b* and its periphery after device features have been created in the second layer of dielectric.

FIG. 5 shows a cross section of a substrate with CVD copper deposition.

FIG. 6 shows a cross-section of a substrate after CVD copper deposition.

FIGS. 10*a* and 10*b* show a cross section and an exploded view of a substrate and its periphery under the first embodiment of the edge and bevel control arrangement in accordance with the invention.

FIGS. 11*a* and 11*b* show a cross section and an exploded view of a substrate and its periphery under the second embodiment of the edge and bevel control arrangement in accordance with the invention.

DESCRIPTION OF THE PREFERRED EMBODIMENTS

Figure 7A:
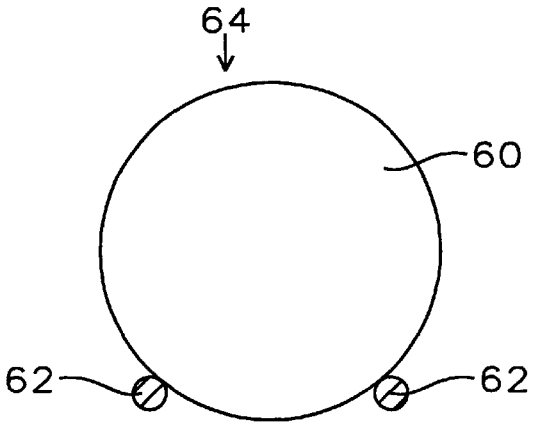
FIGS. 7*a* and 7*b* shows a planar and perspective view of a wafer positioned in accordance with the invention for simultaneous bevel/edge polishing.
Figure 7B:
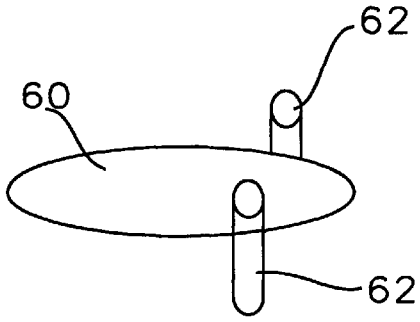

Referring now specifically to FIGS. 7*a* and 7*b,* there is shown a planar and perspective view of a wafer positioned in accordance with the invention.

FIG. 7*a* shows a planar view of the wafer 60, the wafer is held in position be means of two positioning pegs 62. The wafer 60 is inserted following direction 64; a (slight) pressure may be applied in that direction to assure that the wafer rests securely against the positioning pegs 62. Once the wafer has reached this position, it is firmly held in place with wafer suck (not shown).

FIG. 7*b* shows a perspective view of the wafer 60 and the wafer positioning pegs 62 after the wafer has been placed in position.

Figure 8:
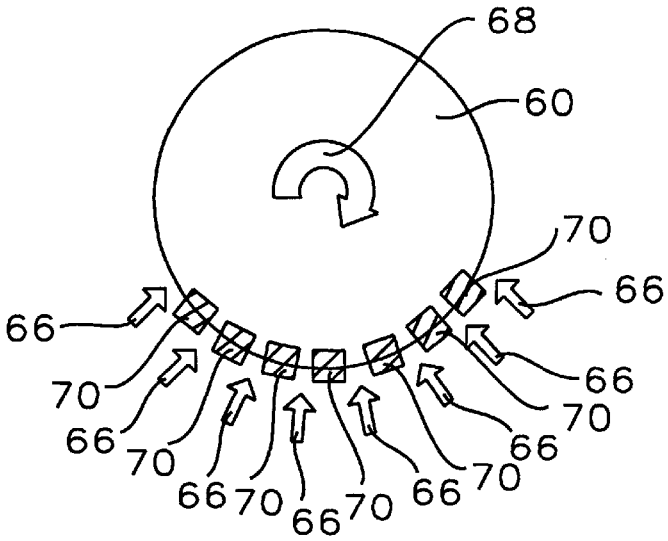
FIG. 8 shows a planar view of an assemblage of bevel/edge heads with their slurry feed arrangement in accordance with first and second embodiment of the invention.

FIG. 8 shows a planar view of an assemblage of bevel/edge heads 70 with their slurry feed 66 in accordance with the invention. The features 70 indicated in FIG. 8 are the bevel/edge heads of the invention that will be explained in further detail in the following figures.

The slurry 66 is entered at slurry entry ports (not shown) while the wafer undergoes the bevel and edge process of the invention. During this process, wafer 60 turns at an even and uniform speed in direction 68. Slurry entry points 66 are located between the bevel/edge heads 70. The invention is not limited as to type and amount of slurry used under the invention; this will be determined by polishing considerations that are state of the art. The invention is also not limited to the number and exact locations of bevel/edge heads that are positioned around the periphery of the substrate while the substrate is being polished in accordance with the invention.

It must be noted in FIG. 8 that the cross sectional dimensions of the bevel/edge heads 70 in the direction of the circumference of the wafer are small when compared with the dimensions of this circumference. This is required in order to assure even and uniform abrasive action by each of the bevel/edge heads 70 over the surface that is being polished.

Figure 1A:
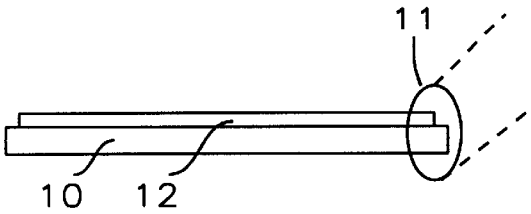
FIG. 1a Prior Art
FIGS. 1*a* and 1*b* show a Prior Art cross section of a substrate and its periphery after the deposition of a first layer of dielectric, the formation of device features in the dielectric and the blanket deposition of a layer of copper.
Figure 1B:
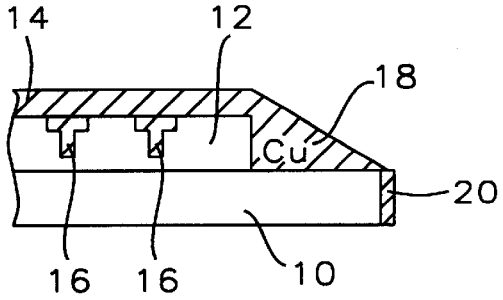
FIG. 1b Prior Art
Figure 2A:
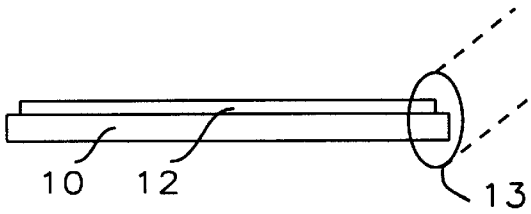
FIG. 2a Prior Art
FIGS. 2*a* and 2*b* show a Prior Art cross-section of the substrate of FIGS. 1*a* and 1*b* and its periphery after the excess copper has been removed from the surface of the dielectric.
Figure 2B:
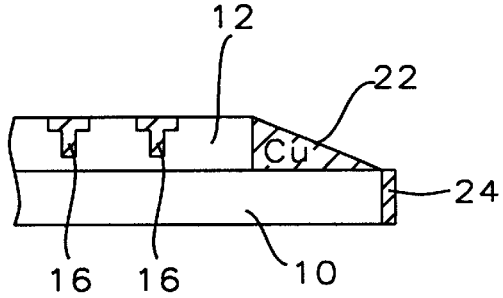
FIG. 2b Prior Art
Figure 3A:
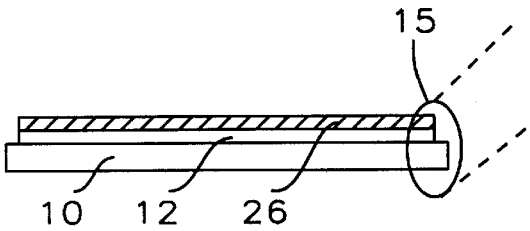
FIG. 3a Prior Art
FIGS. 3*a* and 3*b* show a Prior Art cross section of the substrate of FIGS. 2*a* and 2*b* and its periphery after a second layer of dielectric (the IMD) has been deposited over the first layer of dielectric thereby including the device features created in the first layer of dielectric.
Figure 3B:
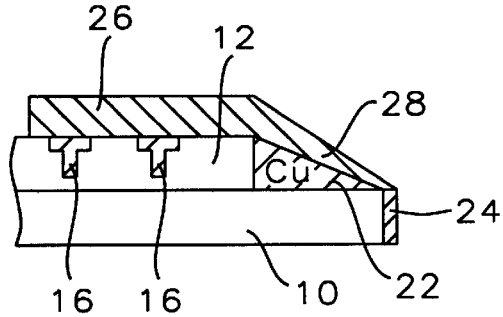
FIG. 3b Prior Art
Figure 9:
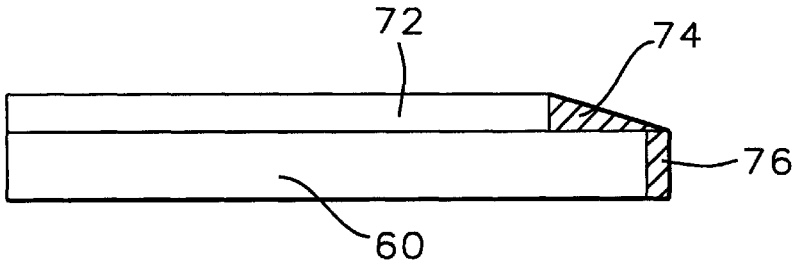
FIG. 9 shows a cross section of the periphery of a substrate after the copper has been deposited over the first layer of dielectric.

FIG. 9 shows a partial cross section of a substrate 60 after a copper layer has been deposited over and removed from the surface of the first layer 72 of dielectric. The deposited layer of copper has not been shown since this layer of copper does not need to be further discussed as part of the invention. The invention addresses, as previously highlighted in FIGS. 2*a* and 2*b*, the removal of copper from the areas that have been highlighted with 74 (bevel) and 76 (edge) in FIG. 9. The cross section of FIG. 9 can be compared with the previously discussed cross section of FIG. 2*b*.

FIGS. 10*a* and 10*b* show a cross section (FIG. 10*a*) and an exploded view of the periphery (FIG. 10*b*) of the substrate 60 under the first embodiment of the bevel and edge polishing arrangement in accordance with the invention.

FIG. 10*a* shows a first layer 72 of dielectric deposited over the surface of wafer 60. The periphery 74 of the substrate with the first layer of dielectric and the bevel/edge head of the invention is further detailed in the exploded view 76 of FIG. 10*b*.

FIG. 10*b* shows a cross section of the bevel/edge head of the first embodiment of the invention. The polishing elements of the bevel/edge head are contained in a holder 82 and consist of a bevel polishers 78 and an edge polisher 80 and a polishing pad support unit 79. By inserting the wafer 60 into the bevel/edge head in the direction 84 the wafer 60 can penetrate the bevel/edge head to the point where the edge polisher 80 stops the substrate. By assuring that the distance between the bevel polisher 78 and the polishing pad support unit 79 is equal to or slightly less than the thickness of the wafer 60 and by pressing the wafer 60 against the edge polisher 80, it is clear that all (three) surfaces of the wafer 60 that have entered the bevel/edge head are in contact with the bevel/edge head and that the bevel and the edge of the substrate periphery (areas 74 and 76 respectively, FIG. 9) are subject to the abrasive action of the bevel/edge head. It is further clear that the abrasive action of the bevel/edge head is applied at precisely those surfaces of the wafer and the wafer to first layer of dielectric interface as are required to be polished, that is areas 74 (bevel) and 76 (edge) of FIG. 9.

Inserting the wafer 60 into the bevel/edge head in the direction 84 can typically be performed manually but is not restricted to manual insertion. This (means of insertion or positioning the wafer with respect to the bevel/edge head) is not further detailed as part of the specification since this means is not germane to or claimed as part of the specification.

The parameters that are important in controlling the abrasive action and therefore the amount and speed of copper that will be removed under the first embodiment of the invention are all readily within the scope of the design parameters of the bevel/edge head. For instance, the longest side of the rectangle that is formed by the bevel polishing pads 78 (as shown in FIG. 10*b*) determines how far the wafer can penetrate the bevel/edge head. The distance between the bevel polishing pads 78 and the polishing pad support unit 79 determines the pressure that will be exerted on the wafer after it enters the bevel/edge head. Typical polishing parameters such as the type of material that is used for the bevel and edge polishing pads, the abrasive characteristics of the slurry that is used and the rotational speed of the wafer that is being polished, determine the polishing speed of the bevel/edge head.

FIGS. 11*a* and 11*b* show a cross section (FIG. 11*a*) and an exploded view of the periphery (FIG. 11*b*) of the substrate 60 under the second embodiment of the bevel and edge polishing arrangement in accordance with the invention.

FIG. 11*a* shows a first layer 72 of dielectric deposited over the surface of wafer 60. The periphery 84 of the substrate with the first layer of dielectric and the bevel/edge head of the invention is further detailed in the exploded view 86 of FIG. 11*b*.

FIG. 11*b* shows a cross section of the bevel/edge head of the second embodiment of the invention. The polishing elements of the bevel/edge head are contained in two holders 88 and consist of a combined bevel/edge polisher 90 and a polisher support unit 92. By inserting the wafer 60 into the bevel/edge head in the direction 94 the wafer 60 can penetrate the bevel/edge head to the point where the bevel/edge polisher 90 stops it. By assuring that the distance between the bevel/edge polishers 90 and the polisher support unit 92 is equal to or slightly less than the thickness of the wafer 60 and by pressing the wafer 60 against the bevel/edge polisher 90 at interface 96, it is clear that all (three) surfaces of the wafer 60 that have entered the bevel/edge head are in contact with the bevel/edge head and that the bevel and the edge of the substrate periphery (areas 74 and 76 respectively, FIG. 9) are subject to the abrasive action of the bevel/edge head. It is further clear that the abrasive action of the bevel/edge head is applied at precisely those surfaces of the wafer and the wafer to first layer of dielectric interface as are required to be polished, that is areas 74 (bevel) and 76 (edge) of FIG. 9.

The parameters that are important in controlling the abrasive action and therefore the amount and speed of copper that will be removed under the second embodiment of the invention are all readily within the scope of the design parameters of the bevel/edge head. For instance, the length of side 98 determines how far the wafer can penetrate the bevel/edge head. The distance between the bevel/edge polishing pad 90 and the polishing support unit 92 determines the pressure that will be exerted on the wafer after it enters the bevel/edge head. Typical polishing parameters such as the type of material that is used for the bevel and edge polishing pads, the abrasive action of the slurry used and the rotational speed of the wafer that is being polished, determines the polishing speed of the bevel/edge head.

It must be noted from FIG. 11*b* that the bevel/edge polishing operation of the periphery of the substrate can be performed by first lowering the combined bevel/edge polishing pad 90 toward the surface of the substrate in a direction that is perpendicular to this surface. After the polishing pad 90 makes contact with the surface of the substrate it now can be moved closer to the center of the substrate to the point where the combined bevel/edge polishing pad 90 touches the edge of the substrate. The polishing pad is then in a position to complete the process of polishing the periphery of the substrate.

Figures 12A, 12B:
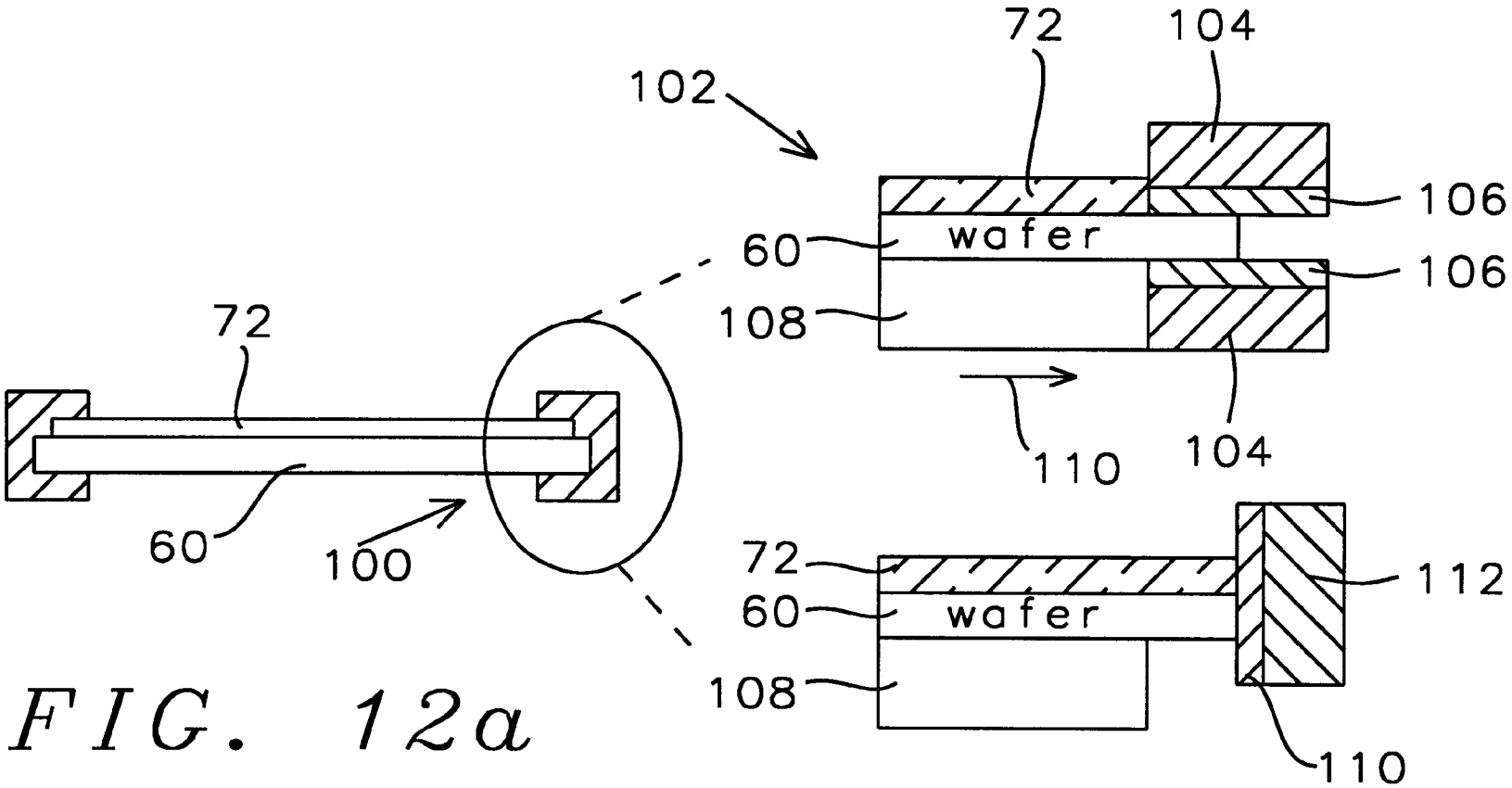
FIGS. 12*a* and 12*b* show a cross section and an exploded view of a substrate and its periphery under the third embodiment of the edge and bevel control arrangement in accordance with the invention.

FIGS. 12*a* and 12*b* show a cross section (FIG. 12*a*) and an exploded view of the periphery (FIG. 12*b*) of the substrate 60 under the third embodiment of the bevel and edge polishing arrangement in accordance with the invention.

FIG. 12*a* shows a first layer 72 of dielectric deposited over the surface of wafer 60. The periphery 100 of the substrate with the first layer of dielectric and the bevel/edge head of the invention is further detailed in the exploded view 102 of FIG. 11*b*.

The polishing action of the bevel/edge head is, for the third embodiment of the invention, divided into two different operations thereby providing increased flexibility of the polishing operation. The first step of the polishing operation is a bevel polish; the second step is an edge polish.

The bevel polish is performed by the polishing elements of the bevel/edge head that are contained in a holder 104 and consist of two polishing pads 106 and a bevel/edge head support unit 108. The lower of the two polishing pads 106 (the pad that is in contact with the bottom surface of the wafer) may not provide any abrasive action since such action is not required of this pad under the scope of the invention. By inserting the wafer 60 into the bevel/edge head in the direction 110 the wafer 60 can penetrate the bevel/edge head as far as is desired. By assuring that the distance between the two polishing pads 106 is equal to or slightly less than the thickness of the wafer 60, it is clear that the beveled part of the copper deposition on wafer 60 (area 74 of FIG. 9) is in contact with the bevel/edge head and is therefore subject to the abrasive action of the bevel/edge head.

The edge polish is performed as a separate operation by using edge-polishing pad 110 that is mounted on polishing pad holder 112.

The parameters that are important in controlling the abrasive action and therefore the amount and speed of copper that will be removed under the third embodiment of the invention are all readily within the scope of the design parameters of the bevel/edge head. For instance, the wafer can penetrate the bevel/edge head as far as desired. The distance between the bevel/edge polishing pads 106 determines the pressure that will be exerted on the wafer after it enters the bevel/edge head and provides therefore direct control over the bevel polishing rate. The edge-polishing rate is, among others, determined by, the polishing pad 110. Typical polishing parameters such as the type of material that is used for the polishing pads, the slurry used and the rotational speed of the wafer that is being polished, determine the polishing speed of the bevel/edge head.

Figure 13A:
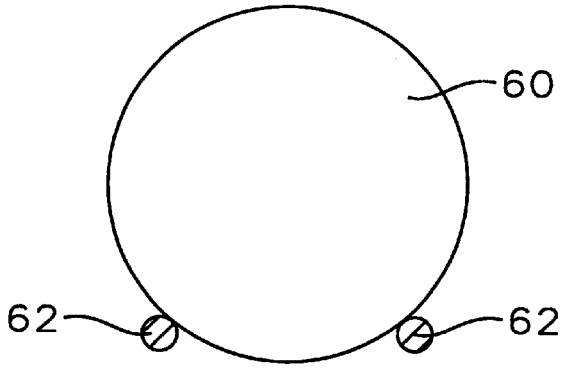
FIGS. 13*a* and 13*b* shows shows a planar and perspective view of a substrate inserted into a bevel/edge polishing arrangement for separate bevel and edge polishing.
Figure 13B:
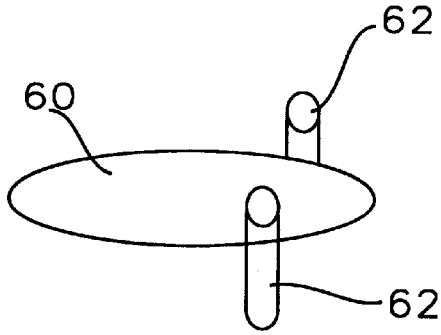

The bevel/edge polishing arrangement as highlighted above under FIG. 12 can be two separate operations but can also be combined into one arrangement whereby the bevel and the edge are polished at the same time while using different polishing heads for these operations. This is further detailed in FIGS. 13*a* and 13*b* and 14. FIGS. 13*a* and 13*b* show the insertion of the wafer in the bevel/edge polishing position; this figure is identical to FIGS. 7*a* and 7*b*.

Figure 14:
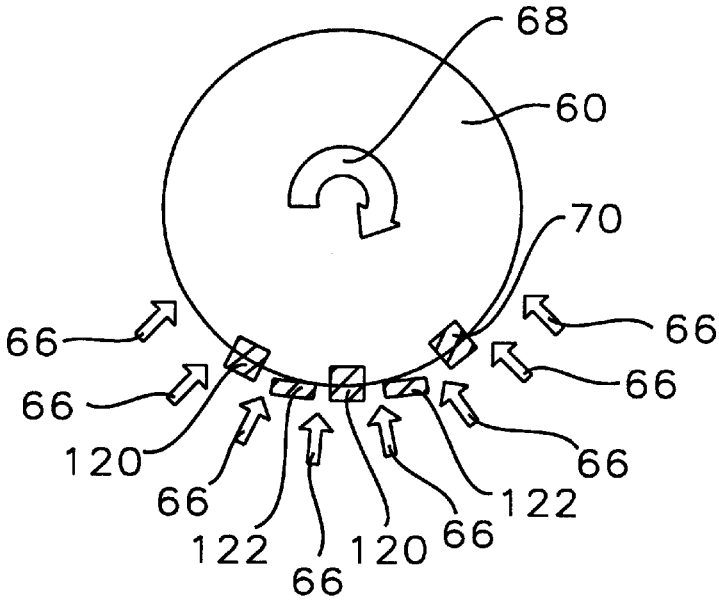
FIG. 14 shows a planar view of an assemblage of bevel/edge heads with their slurry feed arrangement in accordance with third embodiment of the invention.

FIG. 14 shows a planar view of the substrate 60 where bevel-polishing heads 120 have been mounted with edge polishing heads 122 around the periphery of substrate 60. In the arrangement shown in FIG. 14, bevel polishing heads are adjacent to a edge polishing heads, this sequence of bevel and edge polishing heads can be determined for each particular application and is not limited by the invention. Slurry feed 66 is highlighted together with the rotational direction 68 of the substrate 60.

To summarize, the invention provides for removal of copper from the periphery of a substrate on the surface of which wedge and edge formations of copper have accumulated. This by means of a bevel/edge head that has a triangular arrangement of polishing pads or a rectangular arrangement of polishing pad or two separate bevel/edge heads whereby one head performs the wedge polishing while the second head performs the edge polishing.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. A method for removing deposits from the periphery of a substrate, comprising:

(a) providing a substrate, said substrate having been processed and containing layers of dielectric and layers of metal deposited over the active surface of said substrate;

(b) inserting said substrate into an arrangement of bevel/edge polishing heads, said bevel/edge polishing head comprising a polishing pad holder, said polishing pad holder having a cavity wherein are contained a bevel polishing pad and an edge polishing pad and a polishing pad support body, said bevel polishing pad and said edge polishing pad and said polishing pad support body being mounted inside said polishing pad holder in such a manner that:

(i) said bevel polishing pad is in physical contact with the active surface of said substrate, said physical contact extending into a perimeter of said substrate over a measurable amount;

(ii) said edge polishing pad is in physical contact with an edge of said substrate;

(iii) said pad support body is in physical contact with the bottom surface of said substrate in such a manner as to provide support to said substrate; and (iv) the distance between said bevel polishing pad and said pad support body when measured in a direction that is perpendicular to the plane of said substrate is essentially equal to a thickness of said substrate; and (c) removing excess deposits from a periphery of said substrate.

2. The method of claim 1 wherein said inserting said substrate into an arrangement of bevel/edge polishing heads is positioning said substrate against two or more positioning pegs and aligning said substrate into an arrangement of bevel/edge polishing heads around a periphery of said substrate.

3. The method of claim 2 wherein said arrangement of bevel/edge polishing heads is bevel/edge polishing heads being mounted in a concentric pattern around a periphery of said substrate, said bevel/edge polishing heads extending over the surface of a periphery of said substrate by a measurable amount, furthermore providing slurry to the surface of said substrate.

4. The method of claim 1 wherein said bevel polishing pad has a cross section of a right-angled triangle in a plane perpendicular to a plane of the surface of said substrate, a first side of said rectangle other than a hypotenuse and a second side of said rectangle other than the hypotenuse having an abrasive surface, said first side of said rectangle other than the hypotenuse being parallel to a plane of said substrate, furthermore said bevel polishing pad being positioned above a plane of the surface of said substrate.

5. The method of claim 1, said edge polishing pad having one flat surface, said flat surface facing an edge of said substrate.

6. The method of claim 1, said polishing pad support body having at least one flat surface, said flat surface being essentially parallel to a lower plane of said substrate.

7. The method of claim 1 whereby said removing excess deposits from a periphery of said substrate is inserting said substrate into said arrangement of bevel/edge polishing heads thereby rotating said substrate around its central axis, furthermore supplying slurry to the surface of said substrate.

8. An apparatus for removing deposits from the periphery of a substrate, comprising a substrate, said substrate having been processed and containing layers of dielectric and layers of metal deposited over the surface of said substrate said substrate being inserted into an arrangement of bevel/edge polishing heads, said bevel/edge polishing head comprising a polishing pad holder, said polishing pad holder having a cavity wherein are contained a bevel polishing pad and an edge polishing pad and a polishing pad support body, said bevel polishing pad and said edge polishing pad and said polishing pad support body being mounted inside said polishing pad holder in such a manner that:

(i) said bevel polishing pad is in physical contact with the surface of said substrate, said physical contact extending into a perimeter of said substrate over a measurable amount;

(ii) said edge polishing pad is in physical contact with an edge of said substrate;

(iii) said pad support body is in physical contact with the bottom surface of said substrate in such a manner as to provide support to said substrate; and (iv) a distance between said bevel polishing pad and said pad support body when measured in a direction that is perpendicular to the plane of said substrate is about equal to a thickness of said substrate.

9. The apparatus of claim 8 wherein said means for inserting said substrate into an arrangement of bevel/edge polishing heads is positioning said substrate against two or more positioning pegs and aligning said substrate into an arrangement of bevel/edge polishing heads around the periphery of said substrate.

10. The apparatus of claim 9 wherein said arrangement of bevel/edge polishing heads is bevel/edge polishing heads mounted in a concentric pattern around a periphery of said substrate, said bevel/edge polishing heads extending over the surface of a periphery of said substrate by a measurable amount, furthermore providing slurry to the surface of said substrate.

11. The apparatus of claim 8, said bevel polishing pad having a cross section of a right-angled triangle in a plane perpendicular to a plane of the surface of said substrate, a first side of said rectangle other than a hypotenuse and a second side of said rectangle other than a hypotenuse having an abrasive surface, said first side of said rectangle other than a hypotenuse being parallel to a plane of said substrate, furthermore said bevel polishing pad being positioned above a plane of the surface of said substrate.

12. The apparatus of claim 8, said edge polishing pad having one flat surface, said flat surface facing an edge of said substrate.

13. The apparatus of claim 8, said polishing pad support body having at least one flat surface, said flat surface being parallel to a lower plane of said substrate.

* * * * *